US009981483B2

(12) United States Patent
Hamada

(10) Patent No.: US 9,981,483 B2
(45) Date of Patent: May 29, 2018

(54) PRINTING APPARATUS

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/373,283

(22) Filed: Dec. 8, 2016

(65) Prior Publication Data

US 2017/0165977 A1 Jun. 15, 2017

(30) Foreign Application Priority Data

Dec. 9, 2015 (JP) ..... 2015-240285

(51) Int. Cl.

| | |
|---|---|
| ***B41J 2/00*** | (2006.01) |
| ***B41J 2/01*** | (2006.01) |
| ***B41J 3/407*** | (2006.01) |
| ***B41J 11/00*** | (2006.01) |
| ***B41J 11/06*** | (2006.01) |

(52) U.S. Cl.
CPC ..... *B41J 3/4078* (2013.01); *B41J 11/0095* (2013.01); *B41J 11/06* (2013.01)

(58) Field of Classification Search
CPC . B41J 3/4078; B41J 11/06; B41J 11/20; B41J 11/58
USPC ..... 347/101, 104, 110
See application file for complete search history.

(56) References Cited

U.S. PATENT DOCUMENTS

| | | | | |
|---|---|---|---|---|
| 6,908,190 | B2 * | 6/2005 | Iwatsuki | B41J 11/06 101/474 |
| 2003/0197750 | A1 | 10/2003 | Iwatsuki et al. | |
| 2011/0032319 | A1 | 2/2011 | Kaplan et al. | |

FOREIGN PATENT DOCUMENTS

| | | |
|---|---|---|
| JP | 10-265075 | 10/1998 |
| JP | 2003-311938 | 11/2003 |
| JP | 2005-281006 | 10/2005 |
| JP | 2008-094530 | 4/2008 |
| JP | 04670398 | 1/2011 |
| JP | 2012-112082 | 6/2012 |

* cited by examiner

*Primary Examiner* — An Do
(74) *Attorney, Agent, or Firm* — Workman Nydegger

(57) ABSTRACT

A printing apparatus includes a tray which supports a material for textile printing, and can move in a movement direction; a printing unit which performs printing on the material for textile printing supported by the tray; and a contact unit which is provided at a position of being in contact with the material for textile printing supported by the tray, before performing printing by the printing unit. By adopting the printing apparatus with such a configuration, it is possible to improve a printing condition when performing printing on the material for textile printing.

7 Claims, 12 Drawing Sheets

PRINTING APPARATUS

BACKGROUND

1. Technical Field

The present invention relates to a printing apparatus.

2. Related Art

In the related art, various printing apparatuses have been used. In such printing apparatuses, a printing apparatus which performs printing on a material for textile printing has been widely used. In many cases, a material for textile printing has much fluff, and in which wrinkles easily occur, in general. For this reason, since there is a case in which an adverse effect occurs when performing printing due to the fluff, wrinkles, or the like, of the material for textile printing, a technology for suppressing such an adverse effect has been disclosed.

For example, in JP-A-2012-112082, in a printing apparatus which can perform printing using UV curable ink, a printing apparatus provided with a fluff contact member which can remove unnecessary UV curable ink before being cured by ultraviolet light, which is attached to fluff, after performing printing has been disclosed.

The printing apparatus in JP-A-2012-112082 is configured so as to remove unnecessary UV curable ink which is attached to fluff, after performing printing; however, the adverse effect which occurs due to fluff, wrinkles, or the like, of the material for textile printing is not limited to this. In particular, there is a case in which the fluff, wrinkles, or the like, of the material for textile printing deteriorates a printing condition (state of printing face of material for textile printing) when performing printing on the material for textile printing, and it is desired to improve the printing condition when performing printing on the material for textile printing.

SUMMARY

An advantage of some aspects of the invention is to improve a printing condition when performing printing on a material for textile printing.

According to an aspect of the invention, there is provided a printing apparatus which includes a tray which supports a material for textile printing, and can move in a movement direction; a printing unit which performs printing on the material for textile printing supported by the tray; and a contact unit which is provided at a position of being in contact with the material for textile printing supported by the tray, before performing printing by the printing unit.

According to the aspect, the contact unit which is provided at a position of being in contact with the material for textile printing supported by the tray, before performing printing by the printing unit, is provided. That is, it is possible to improve a state of a printing face of the material for textile printing, using the contact unit which is provided at the position of being in contact with the material for textile printing prior to performing printing by the printing unit. For this reason, it is possible to improve a printing condition when performing printing on the material for textile printing.

Here, "improving a state of a printing face of the material for textile printing" includes, for example, removing wrinkles, laying or removing fluff, destaticizing the material for textile printing, or the like.

In the printing apparatus, the tray may move to a first position at which the material for textile printing is mounted, and the contact unit may be provided between the first position and the printing unit.

According to the aspect, the tray can move to the first position at which the material for textile printing is mounted, and the contact unit is provided between the first position and the printing unit. That is, the contact unit is provided between a mounting position of the material for textile printing and a printing position on a movement path of the tray. For this reason, it is possible to improve a state of a printing face of the material for textile printing on the way to a printing start position (for example, standby position before starting printing) from a mounting position of the material for textile printing of the tray.

In the printing apparatus, the tray may move to a second position as a standby position before starting printing on the material for textile printing, and the contact unit may be displaced between a contact position of being in contact with the material for textile printing which is supported by the tray and a non-contact position of not being in contact with the material for textile printing which is supported by the tray, and may be displaced so as to be located at the contact position when the tray moves toward the second position from the first position, and located at the non-contact position when the tray moves toward the first position from the second position.

According to the aspect, the contact unit is displaced so as to be located at the contact position when the tray moves toward the second position from the first position, and be located at the non-contact position when the tray moves toward the first position from the second position. For this reason, for example, it is possible to set so that the contact unit comes into contact with the material for textile printing when a tray corresponding to a situation before starting printing is on the way to the standby position (printing start position) before starting printing from the mounting position of the material for textile printing, and does not come into contact with the material for textile printing when a tray corresponding to a printing time is on the way to the mounting position of the material for textile printing from the printing start position. Accordingly, it is possible to improve a state of the printing face of the material for textile printing before starting printing, and suppress a harmful effect which occurs when the contact unit comes into contact with the printing face of the material for textile printing in the middle of printing (rubbing printing face on which printing is performed, or the like).

The printing apparatus may further include a cleaning unit which removes foreign substances attached to the contact unit.

According to the aspect, the cleaning unit which removes foreign substances attached to the contact unit is provided. For this reason, it is possible to suppress a situation in which the material for textile printing in a state of which the printing face is improved by removing foreign substances from the printing face of the material for textile printing using the contact unit which comes into contact with the material for textile printing is attached with the foreign substances again.

In the printing apparatus, the contact unit may be configured of a material with conductivity.

According to the aspect, the contact unit is configured of a material with conductivity. For this reason, it is possible to destaticize the material for textile printing, and improve a printing condition when performing printing on the material for textile printing.

In the printing apparatus, the contact unit may include a sensor which detects an object on the tray by being in contact with the object on the tray.

According to the aspect, the contact unit includes a sensor which detects an object on the tray by being in contact with the object on the tray. That is, the contact unit also functions as an obstacle detecting sensor.

For this reason, in a case in which there is an obstacle on the printing face of the material for textile printing, it is possible to detect the obstacle.

The printing apparatus may be further provided with a detecting unit which detects an object located at a position of a predetermined height or more with respect to the tray.

According to the aspect, the detecting unit which detects an object located at a position of a predetermined height or more with respect to the tray is provided. Since the detecting unit can detect an object in a non-contact manner, for example, it is possible to detect an obstacle in a case in which there is the obstacle on the printing face of the material for textile printing, without deteriorating a printing condition when performing printing on the material for textile printing, after improving the printing condition when performing printing on the material for textile printing using the contact unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment (FIGS. 1 to 11C)

Hereinafter, a printing apparatus 1 according to a first embodiment of the invention will be described with reference to accompanying drawings.

First, an outline of the printing apparatus 1 according to the embodiment will be described.

Figure 1:
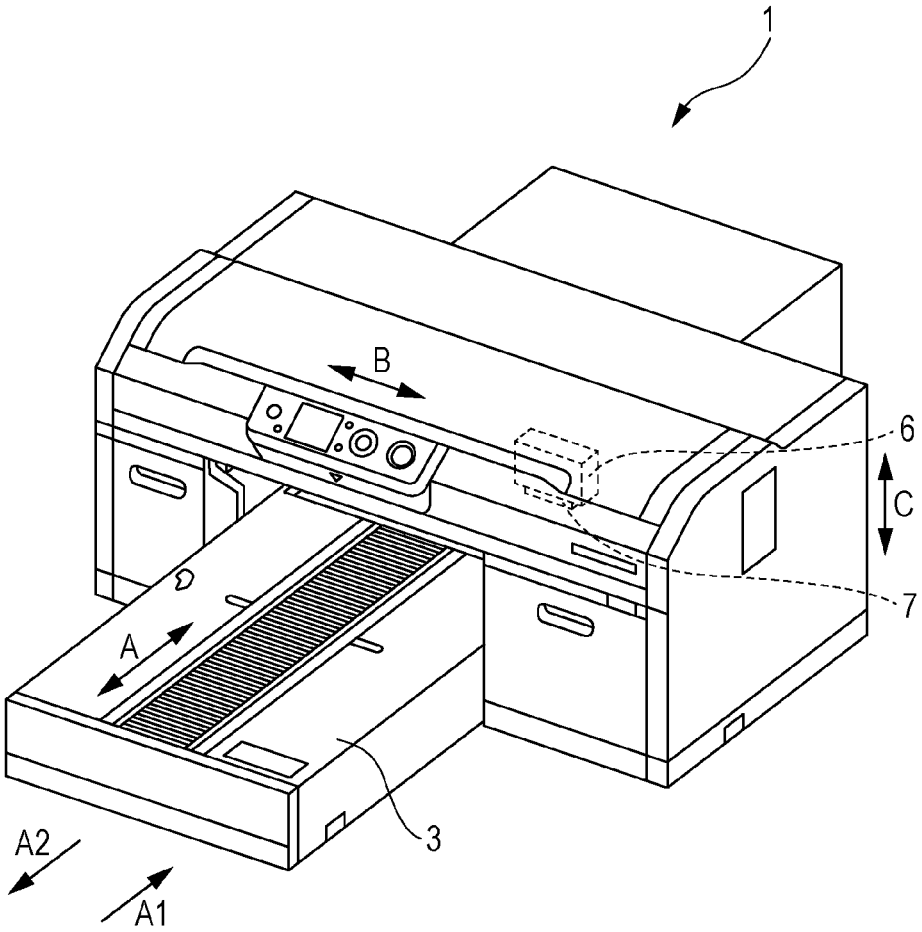
FIG. 1 is a schematic perspective view of a printing apparatus according to a first embodiment of the invention.
Figure 2:
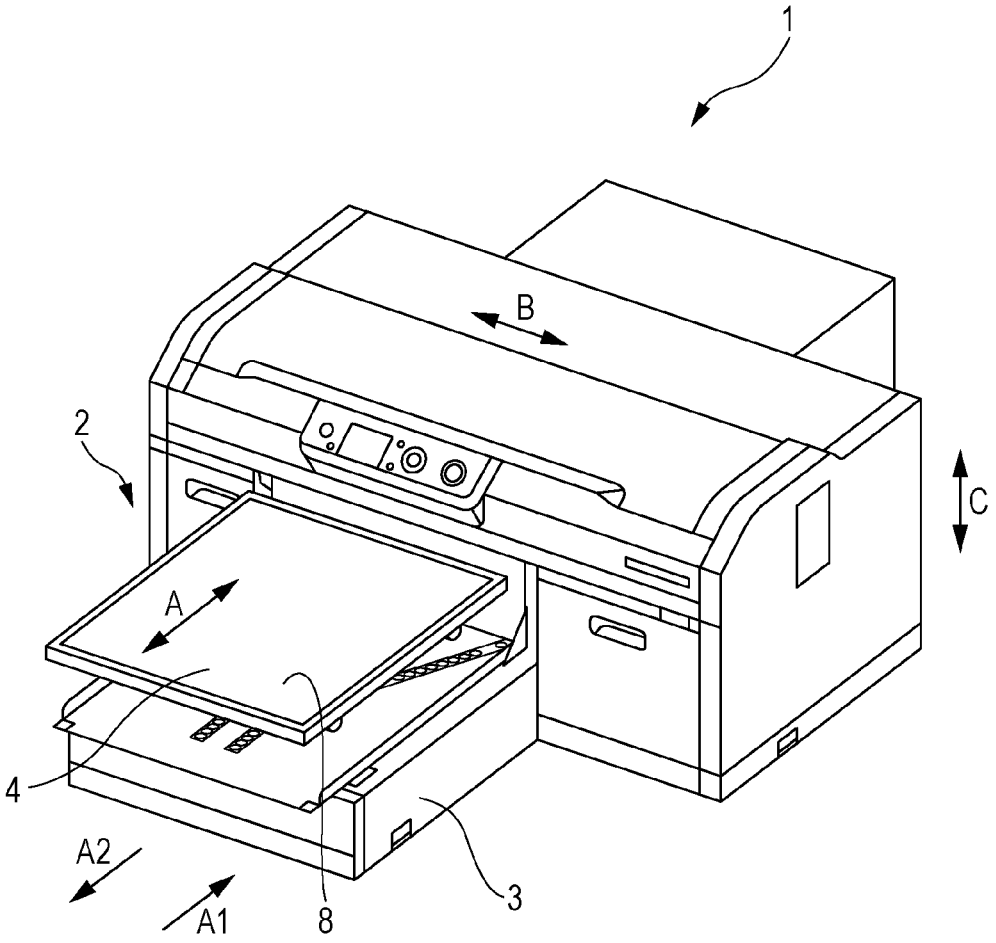
FIG. 2 is a schematic perspective view of the printing apparatus according to the first embodiment of the invention.

FIGS. 1 and 2 are schematic perspective views of the printing apparatus 1 according to the embodiment, in which FIG. 1 illustrates a state in which a tray 4 as a support unit of a material for textile printing M (refer to FIGS. 10A to 11C) as a medium of the printing apparatus 1 in the embodiment is located at a printing start position (second position as standby position before starting printing), and FIG. 2 illustrates a state in which the tray 4 is located at a set position of the material for textile printing M (first position at which material for textile printing M is mounted).

Figure 3:
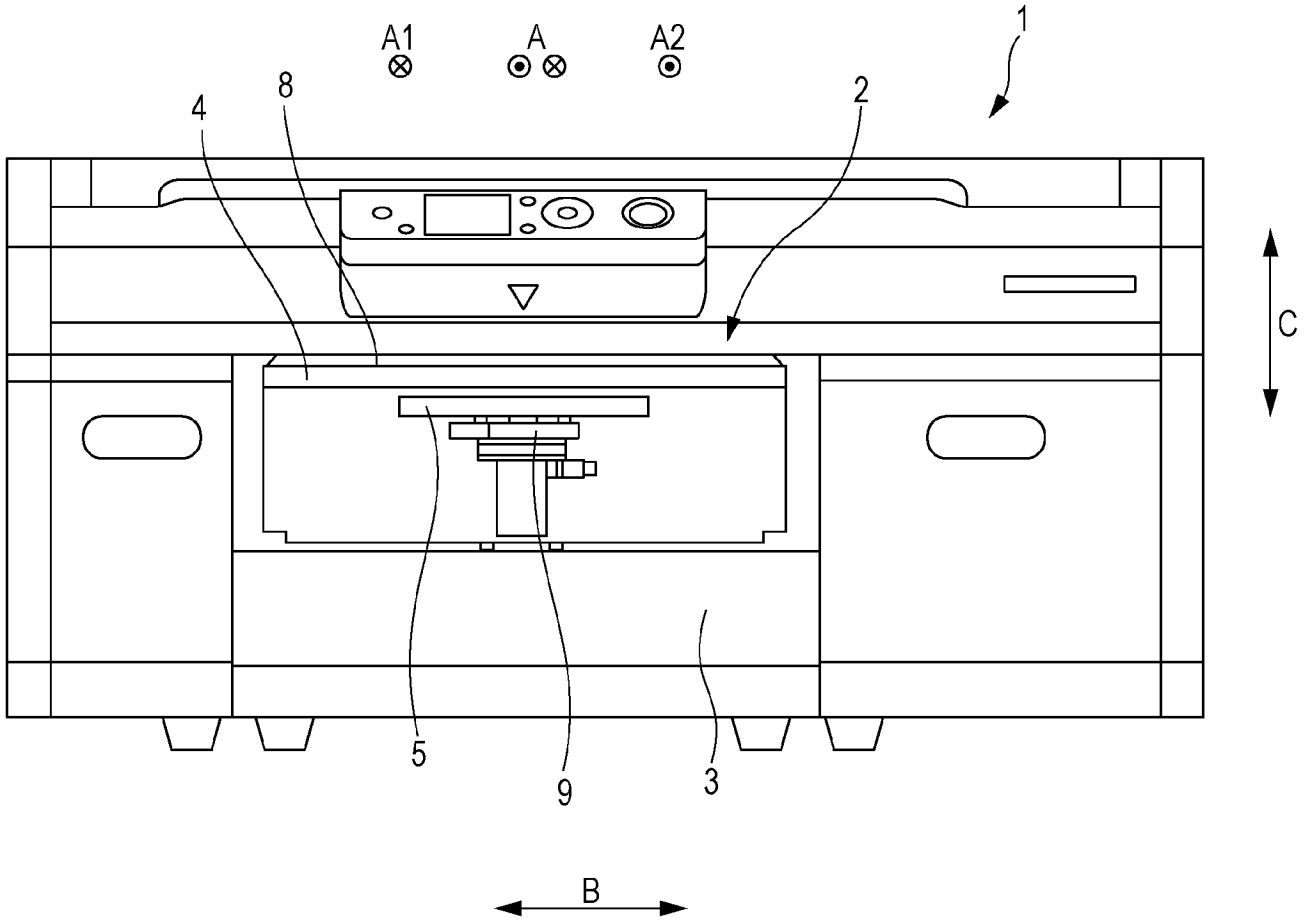
FIG. 3 is a schematic front view of the printing apparatus according to the first embodiment of the invention.
Figure 4:
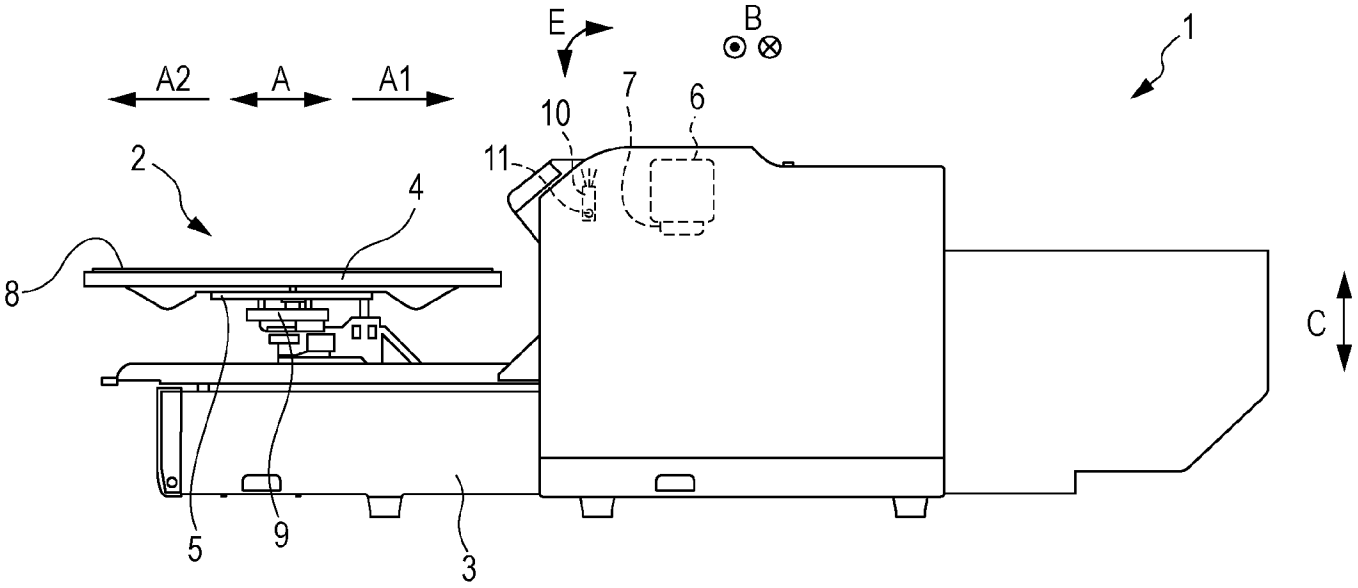
FIG. 4 is a schematic side view of the printing apparatus according to the first embodiment of the invention.
Figure 5:
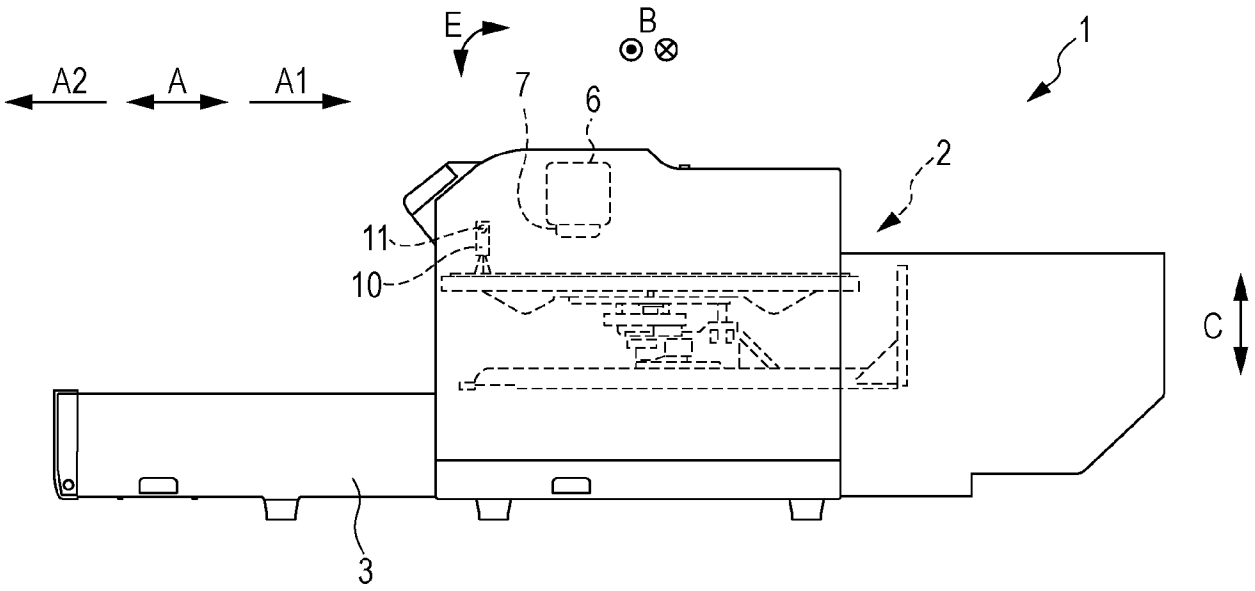
FIG. 5 is a schematic side view of the printing apparatus according to the first embodiment of the invention.
Figure 6:
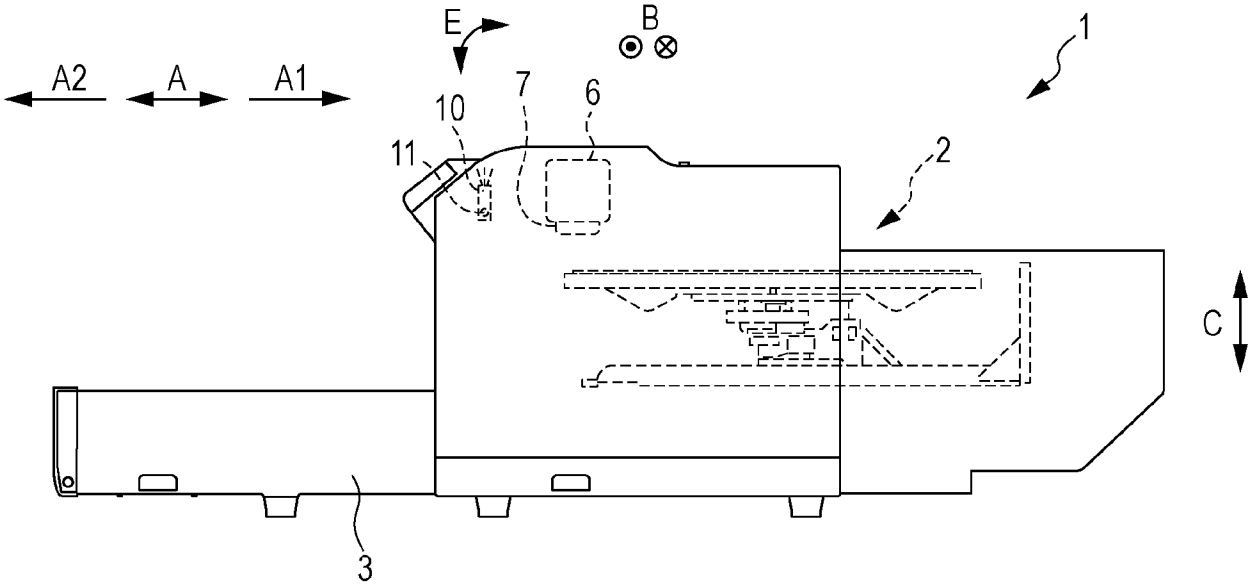
FIG. 6 is a schematic side view of the printing apparatus according to the first embodiment of the invention.

FIG. 3 is a schematic front view of the printing apparatus 1 according to the embodiment. FIGS. 4 to 6 are schematic side views of the printing apparatus 1 according to the embodiment, in which FIG. 4 illustrates a state in which the tray 4 is located at the set position of the material for textile printing M, FIG. 5 illustrates a state in which the tray 4 moves the printing start position from the set position of the material for textile printing M, and FIG. 6 illustrates a state in which the tray 4 is located at the printing start position.

In any of FIGS. 1 to 6, the material for textile printing M is not illustrated.

The printing apparatus 1 according to the embodiment is provided with a medium support unit 2 which moves in a movement direction A in a state of supporting the material for textile printing M on a support face 8 of the tray 4. The medium support unit 2 includes the tray 4 as the support unit of the material for textile printing M. The printing apparatus 1 is provided with a medium transport unit 3 which transports the material for textile printing M supported by the tray 4 in the movement direction A. The movement direction A includes a direction A1, and a direction A2 which is a direction opposite to the direction A1. In addition, the tray 4 is mounted on a stage 5. The tray 4 moves in a height direction C along with the stage 5, when rotating a rotary lever 9. In addition, as the material for textile printing M, it is possible to use various textiles (woven fabric, cloth, or the like).

A printing head 7 which can perform printing on the material for textile printing M by ejecting ink is provided in a main body of the printing apparatus 1. In the printing apparatus 1 according to the embodiment, a desired image is formed by ejecting ink onto the material for textile printing M which is supported by the tray 4 from the printing head 7 while causing the printing head 7 to reciprocate in the scanning direction B, by causing a carriage 6 in which the printing head 7 is provided to reciprocate in the scanning direction B which intersects the movement direction A. According to the embodiment, the carriage 6 provided with the printing head 7 can move in the scanning direction B, and corresponds to a printing unit which can print an image on the material for textile printing M.

In the printing apparatus 1 according to the embodiment, a near side in FIGS. 1 and 2 (lower-left direction) is a set position of the material for textile printing M (corresponding to FIGS. 2 and 4) on the tray 4. In addition, printing is performed while moving the tray 4 in the direction A2 in the movement direction A, after moving the tray 4 onto which the material for textile printing M is set in the direction A1 in the movement direction A to the printing start position (corresponding to FIGS. 1 and 6) on a depth side (upper-right direction) in FIGS. 1 and 2.

As illustrated in FIGS. 4 to 6, a contact unit 10 which can come into contact with the material for textile printing M which is supported by the tray 4 when moving the tray 4 from the set position to the printing start position (refer to FIG. 5) is provided in the main body of the printing apparatus 1. Here, the contact unit 10 can rotate in a rotation direction E based on a rotation shaft 11 which extends in the scanning direction B. In detail, it is a configuration in which the contact unit 10 can be displaced from a contact position at which it is possible to come into contact with the material for textile printing M which is illustrated in FIG. 5 to a non-contact position at which it is not possible to come into contact with the material for textile printing M which is illustrated in FIGS. 4 and 6. The contact unit 10 will be described in detail later.

Subsequently, the contact unit 10 as a main portion of the printing apparatus 1 will be described.

Figure 7:
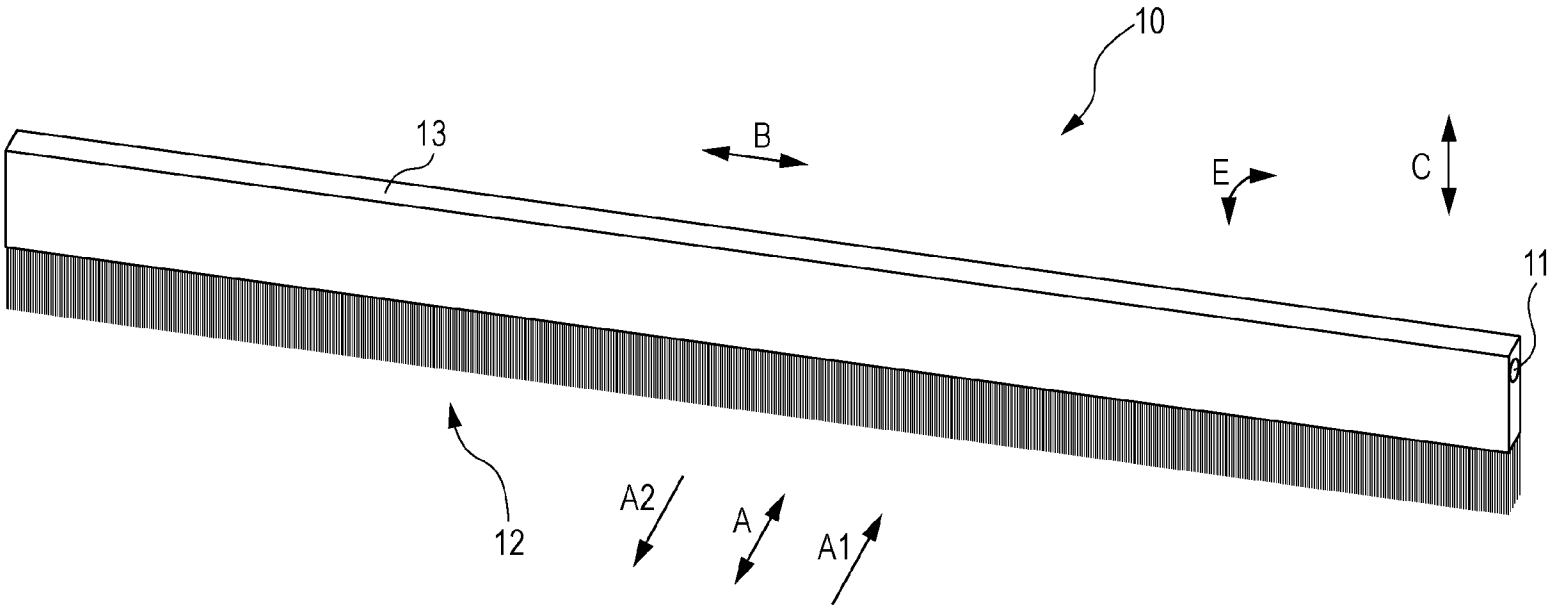
FIG. 7 is a schematic perspective view of a main portion of the printing apparatus according to the first embodiment of the invention.
Figure 8:
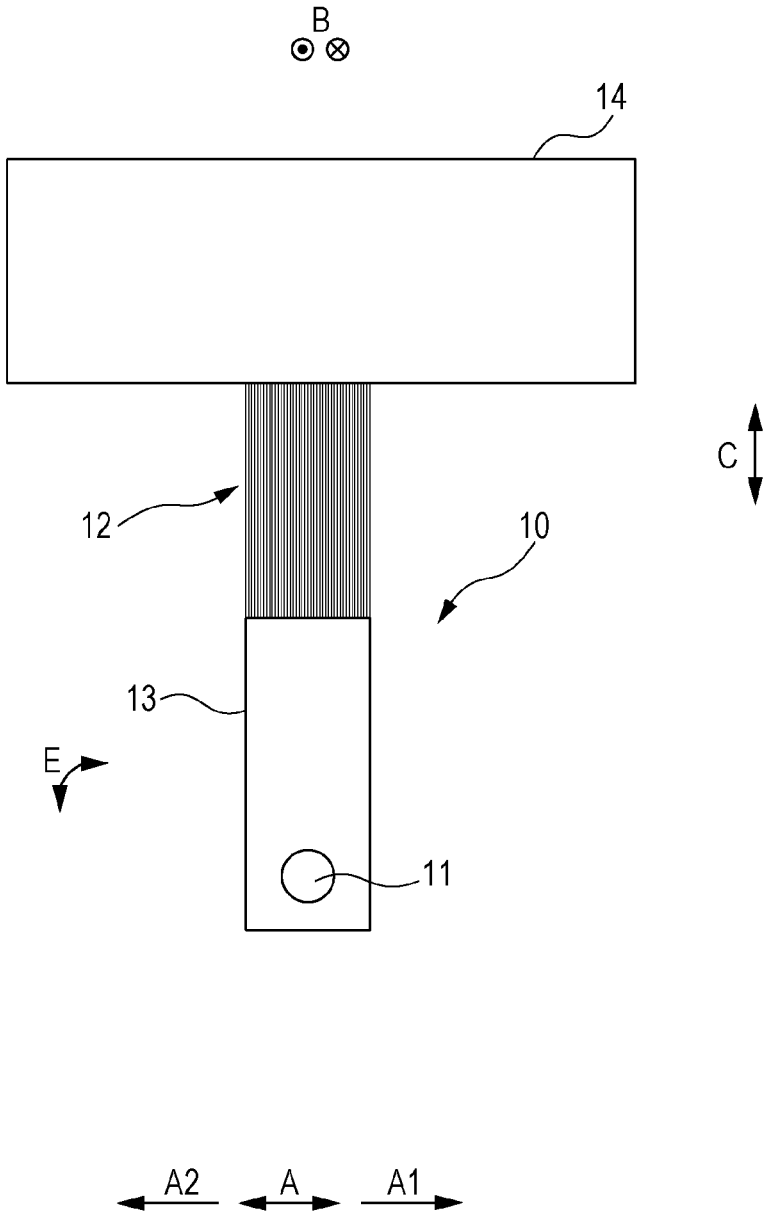
FIG. 8 is a schematic side view of a main portion of the printing apparatus according to the first embodiment of the invention.

FIG. 7 is a schematic perspective view of the contact unit 10 as the main portion of the printing apparatus 1 in the embodiment, and FIG. 8 is a schematic side view which illustrates the contact unit 10, and a cleaning unit 14 of the contact unit 10.

The contact unit 10 according to the embodiment extends in the scanning direction B as illustrated in FIG. 7, and a length thereof is set so as to correspond to a length of the tray 4 in the scanning direction B. The contact unit 10 includes a destaticizing brush 12 which can come into contact with the material for textile printing M in a contact position, a base portion 13 in which the destaticizing brush 12 is formed, and the rotation shaft 11 as a rotation fulcrum when rotating the contact unit 10 provided in the base portion 13 in the rotation direction E. At this time, the base portion 13, and a frame, or the like, onto which the base portion is mounted are also conductive, and electricity flows toward a ground from the destaticizing brush 12. The contact unit 10 is provided with a pressure sensor (not illustrated) in the inside, and it is a configuration in which it is possible to determine that an obstacle (foreign substances) is present on the material for textile printing M when a pressure of a predetermined threshold value or more is detected when the contact unit 10 comes into contact with the material for textile printing M. The threshold value can be appropriately set from an expected value (experiment value), or the like, in a pressure range in a case of no obstacle on the material for textile printing M, in a case in which wrinkles W (refer to FIG. 10) occur in the material for textile printing M, or based on a state of fluff F (refer to FIG. 11), or the like.

As illustrated in FIG. 8, the printing apparatus 1 according to the embodiment is provided with the cleaning unit 14 which has an adhesive face. The cleaning unit 14 in the embodiment is a circular shape when viewed in the movement direction A, is a rectangular columnar shape when viewed in the scanning direction B, and is formed in a shape in which an adhesive sheet is wound around a side face thereof with the adhesive face on the outside. As illustrated in FIG. 8, it is a configuration in which the columnar cleaning unit 14 can remove foreign substances such as fluff F attached to the destaticizing brush 12 while rolling, by moving the cleaning unit 14 in the scanning direction B at a position at which the adhesive sheet and the destaticizing brush 12 come into contact, by displacing the contact unit 10 so that the destaticizing brush 12 comes to the upper side (non-contact position). In a case in which the cleaning unit 14 is contaminated by the foreign substances, it is possible to recover a cleaning performance, since a new adhesive face comes on by removing the adhesive sheet of one cycle.

Subsequently, an electrical configuration in the printing apparatus 1 according to the embodiment will be described.

Figure 9:
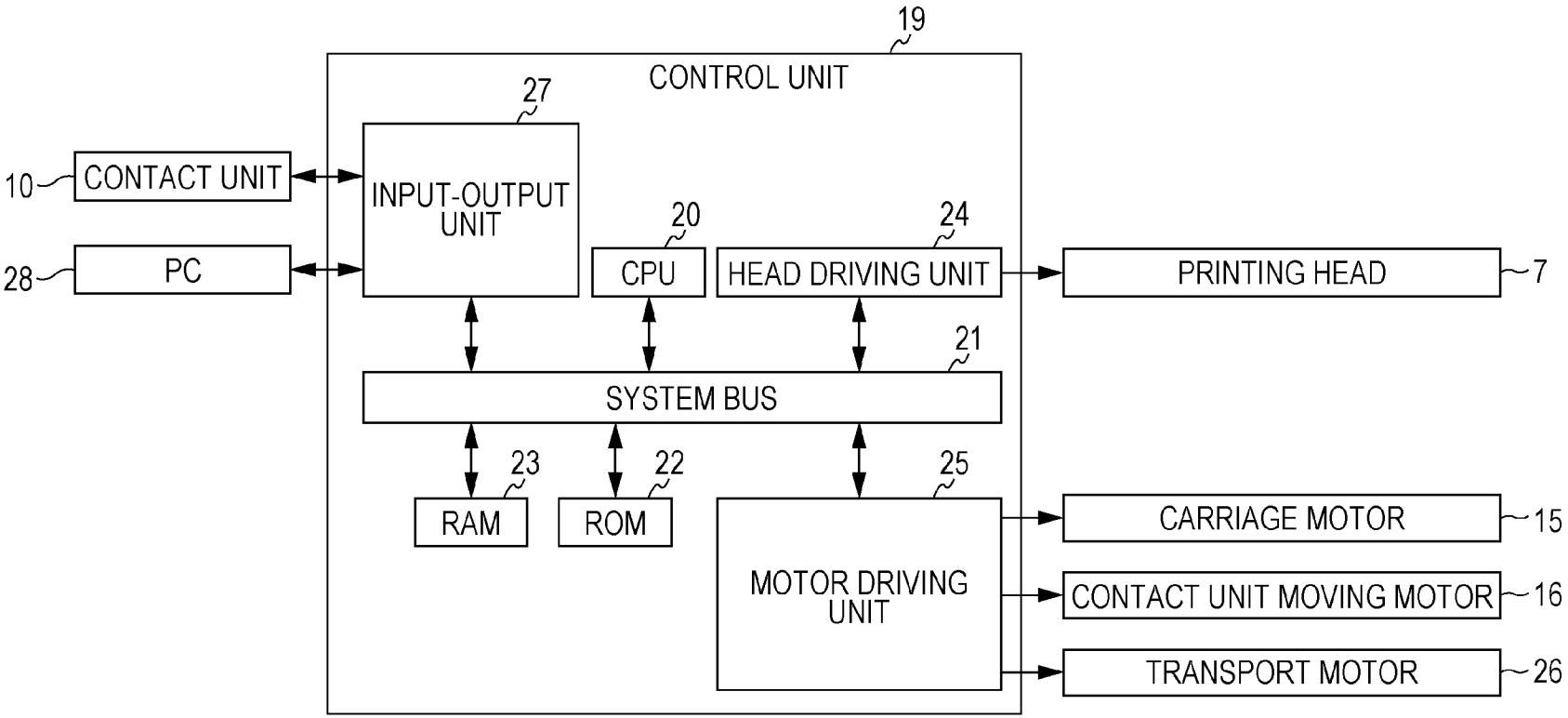
FIG. 9 is a block diagram of the printing apparatus according to the first embodiment of the invention.

FIG. 9 is a block diagram of the printing apparatus 1 according to the embodiment.

A control unit 19 is provided with a CPU 20 which administrates a control of the entire printing apparatus 1. The CPU 20 is connected to a ROM 22 which stores various control programs, and the like, which are executed by the CPU 20, and a RAM 23 which can temporarily store data through a system bus 21.

The CPU 20 is connected to a head driving unit 24 for driving the printing head 7 (causing printing head to eject ink) through the system bus 21.

The CPU 20 is connected to a motor driving unit 25 through the system bus 21. In addition, the motor driving unit 25 is connected to a carriage motor 15, a motor for moving contact unit 16, and a transport motor 26 which is provided in the medium transport unit 3 in order to transport the material for textile printing M (that is, moving medium support unit 2).

In addition, the CPU 20 is connected to an input-output unit 27 through the system bus 21. The input-output unit 27 is connected to the contact unit 10 in which a pressure sensor is provided, and a PC 28 for performing transceiving of data such as printing data and a signal.

As described above, the printing apparatus 1 according to the embodiment is provided with the tray 4 which can move in the movement direction A by supporting the material for textile printing M, and the carriage 6 which performs printing on the material for textile printing M supported by the tray 4. In addition, as illustrated in FIGS. 4 to 6, the printing apparatus includes the contact unit 10 which is provided at a position of being in contact with the material for textile printing M supported by the tray 4, before performing printing by the carriage 6.

With such a configuration, the printing apparatus 1 according to the embodiment can improve a state of the printing face of the material for textile printing M using the contact unit 10 which is provided at a position of being in contact with the material for textile printing M before performing printing by the carriage 6. In the embodiment, the destaticizing brush 12 is used in the contact unit 10; however, another member may be used. For example, a brush with no destaticizing function, sponge, or the like, may be used as the contact unit 10.

The invention is related to a configuration of including a support unit which can move in the movement direction A by supporting the material for textile printing M. Here, "the support unit which can move in the movement direction A by supporting the material for textile printing M" means a support unit which can move the material for textile printing M by moving the entire position along with the material for textile printing M, and means that a support unit with a configuration which can move the material for textile printing M by moving only a part of constituent portion, or by changing a posture without moving the entire position such as a configuration of supporting the material for textile printing M using an endless belt is not included. The reason for this is that it is not easy for a support unit which can move in the movement direction A by supporting the material for textile printing M to grasp an interval between an ejecting unit and the support face 8 before performing printing, since positions of the ejecting unit and the support face 8 in the set position of the material for textile printing M are separated, and in the printing apparatus 1 with a configuration which includes such a support unit, an improvement of the printing face of the material for textile printing M is particularly desired, in order to suppress a contact, or the like, between the ejecting unit and the material for textile printing M.

Here, a specific example of improving a state of the printing face of the material for textile printing M will be described. As a method of improving the state of the printing face of the material for textile printing M, there is, for example, removing the wrinkles W, laying or removing the fluff F, destaticizing the material for textile printing M, or the like. The printing apparatus 1 according to the embodiment has a configuration in which it is possible to improve a printing condition when performing printing on the material for textile printing M, since it is possible to use such methods.

Figure 10A:
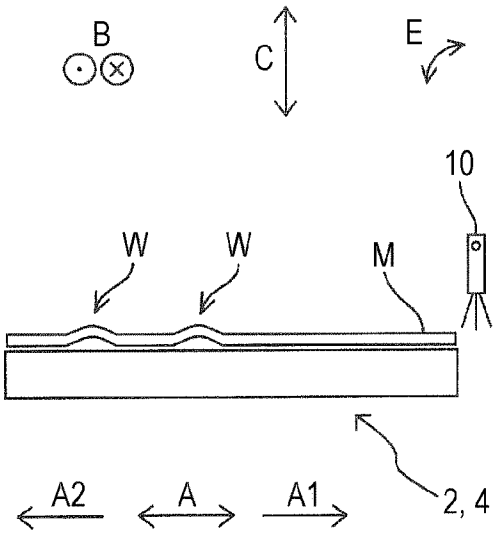
FIGS. 10A to 10C are diagrams which explain an effect of the printing apparatus according to the first embodiment of the invention.
Figure 10B:
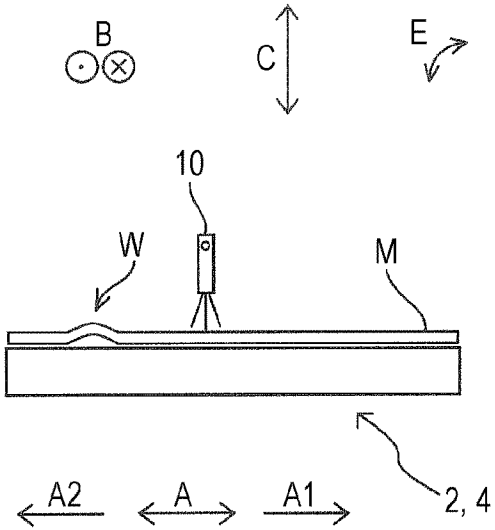
Figure 10C:
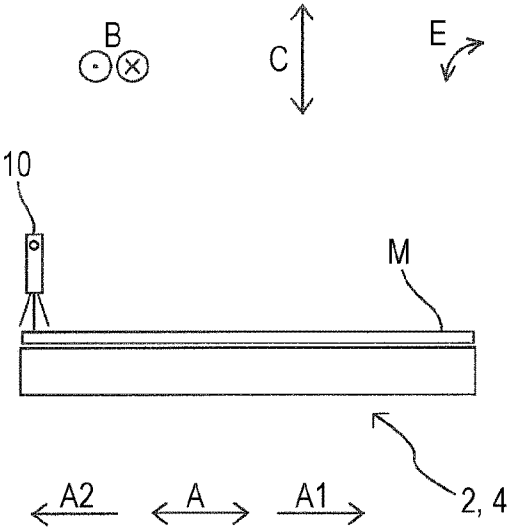

FIGS. 10A to 10C are diagrams for explaining a process of removing wrinkles W in the material for textile printing M using the contact unit 10.

First, FIG. 10A illustrates a state in which the contact unit 10 is located at a contact position, is moving in the direction A1 toward the printing start position from the set position, a state before the contact unit 10 and the material for textile printing M are in contact, and a state in which the wrinkles W occur in the material for textile printing M. When printing is performed in a state in which the wrinkles W occurred in the material for textile printing M in this manner, there is a case in which a landing position of ink ejected from the printing head 7 is shifted in an occurrence region of the wrinkles W, or the printing head 7 and the material for textile printing M come into contact with each other.

Subsequently, FIG. 10B illustrates a state in which the tray 4 is moving in the direction A1 toward the printing start position from the set position, and a state in which the contact unit 10 is in contact with the material for textile printing M halfway, which is supported by the tray 4. The wrinkles W of the material for textile printing M are removed in a portion of being in contact with the contact unit 10 already, along with a movement of the tray 4.

In addition, FIG. 10C illustrates a state in which the tray 4 is moving in the direction A1 toward the printing start position from the set position, and a state in which the contact unit 10 is in contact with the material for textile printing M to the last, which is supported by the tray 4. The wrinkles W are removed in the entire material for textile printing M.

Figure 11A:
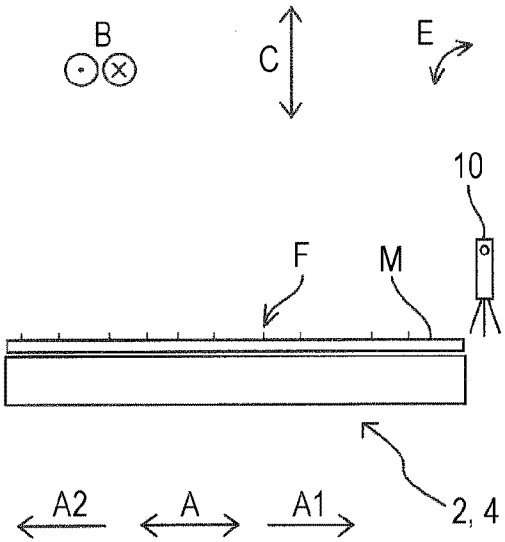
FIGS. 11A to 11C are diagrams which explain an effect of the printing apparatus according to the first embodiment of the invention.
Figure 11B:
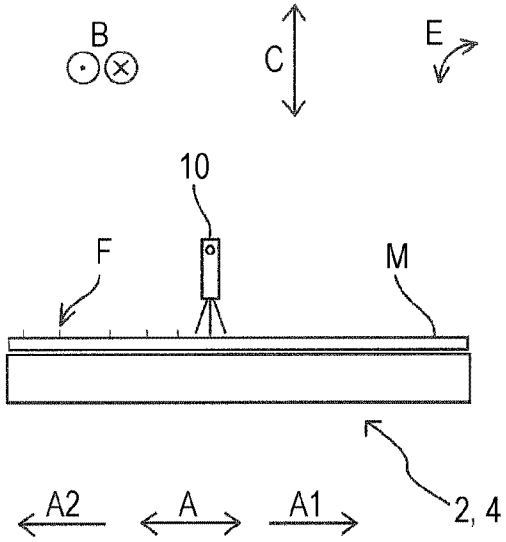
Figure 11C:
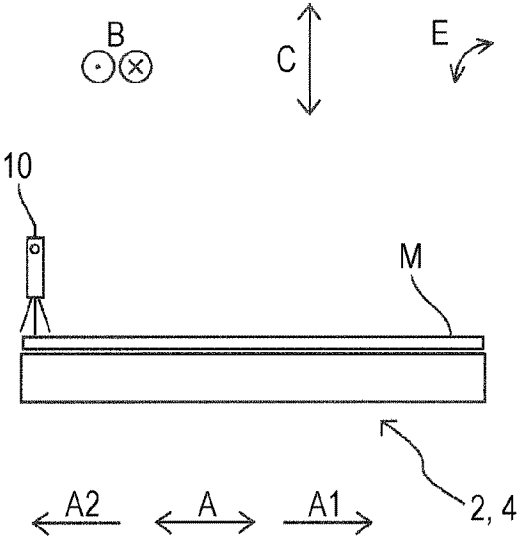

FIGS. 11A to 11C are diagrams for explaining a process in which fluff F in the material for textile printing M are laid or removed, using the contact unit 10.

First, FIG. 11A illustrates a state in which the contact unit 10 is located at a contact position, is moving in the direction A1 toward the printing start position from the set position, a state before the contact unit 10 and the material for textile printing M are in contact, and a state in which much fluff F are present in the material for textile printing M. When performing printing in a state in which much fluff F are present in the material for textile printing M in this manner, there is a case in which the printing head 7 and the fluff F are in contact, and the material for textile printing M is contaminated, or an ejection failure may occur.

Subsequently, FIG. 11B illustrates a state in which the tray 4 is moving in the direction A1 toward the printing start position from the set position, and a state in which the contact unit 10 is in contact with the material for textile printing M halfway, which is supported by the tray 4. The fluff F of the material for textile printing M is laid or removed in a portion of being in contact with the contact unit 10 already, along with a movement of the tray 4.

In addition, FIG. 11C illustrates a state in which the tray 4 is moving in the direction A1 toward the printing start position from the set position, and a state in which the contact unit 10 is in contact with the material for textile printing M to the last, which is supported by the tray 4. The fluff F is laid or removed in the entire material for textile printing M.

The destaticizing brush 12 of the contact unit 10 is formed of a conductive material (conductive fiber, or the like). For this reason, it is possible to destaticize the material for textile printing M, and improve a printing condition when performing printing on the material for textile printing M.

The destaticizing brush 12 according to the embodiment is made of metal; however, it is not limited to metal, and may be formed of another conductive material such as a carbon material, for example.

As described above, in the printing apparatus 1 according to the embodiment, the tray 4 can move to the set position (refer to FIGS. 2 and 4) as the first position at which the material for textile printing M is mounted, and as illustrated in FIG. 4, the contact unit 10 is provided between the set position and the carriage 6. That is, the contact unit 10 is provided between the mounting position of the material for textile printing M and a printing position in a movement path of the tray 4. For this reason, it is a configuration in which it is possible to improve a state of the printing face of the material for textile printing M on the way (refer to FIG. 5) to the printing start position (for example, standby position before starting printing) from the mounting position of the material for textile printing M of the tray 4.

In detail, in the printing apparatus 1 according to the embodiment, the tray 4 can move to the second position (printing start position: refer to FIGS. 1 and 6) as the standby position before starting printing on the material for textile printing M, and the contact unit 10 can be displaced between the contact position (refer to FIG. 5) of being in contact with the material for textile printing M supported by the tray 4 and the non-contact position (refer to FIGS. 4 and 6) of not being in contact with the material for textile printing M supported by the tray 4.

The contact unit 10 is configured to be displaced so as to be located at the contact position when the tray 4 moves toward the printing start position from the set position, and located at the non-contact position when the tray 4 moves toward the set position from the printing start position (that is, in the middle of performing printing in printing apparatus 1 according to the embodiment). That is, the contact unit 10 is in contact with the material for textile printing M when the tray 4 corresponding to a situation before starting printing is on the way to the standby position (printing start position) before starting printing, from the mounting position of the material for textile printing M, and is not in contact with the material for textile printing M when the tray 4 corresponding to a printing time is on the way to the mounting position of the material for textile printing M from the printing start position. Accordingly, it is possible to improve a state of the printing face of the material for textile printing M before starting printing, and suppress a harmful effect which occurs when the contact unit comes into contact with the printing face of the material for textile printing M in the middle of printing (rubbing printing face on which printing is performed, or the like).

As illustrated in FIG. 8, the printing apparatus 1 according to the embodiment is provided with the cleaning unit 14 which removes foreign substances attached to the contact unit 10. For this reason, it is a configuration in which it is possible to suppress a situation in which the material for textile printing M, in a state in which the state of the printing face is improved by removing foreign substances from the printing face of the material for textile printing M using the contact unit 10 which comes into contact with the material for textile printing M, is attached with the foreign substances again.

As described above, the cleaning unit 14 according to the embodiment has a configuration of including the adhesive face; however, it is not limited to such a configuration, and may be a configuration in which foreign substances attached to the destaticizing brush 12 are removed by performing suctioning, or the like.

As described above, the contact unit 10 according to the embodiment is provided with a pressure sensor (not illustrated) in the inside. In other words, the contact unit 10 according to the embodiment includes a sensor which detects an object on the tray 4 by being in contact with the object on the tray 4. That is, the contact unit 10 also functions as an obstacle detecting sensor. For this reason, in a case in which there is an obstacle on the printing face of the material for textile printing M, it is possible to detect the obstacle.

The contact unit 10 according to the embodiment has a configuration of being provided with the pressure sensor (not illustrated) in the inside; however, it is not limited to such a configuration, and it may be a configuration in which it is possible to detect an obstacle in a case in which the obstacle is present on the printing face of the material for textile printing M using another configuration (configuration in which sensor other than pressure sensor is provided, or the like).

Figure 12:
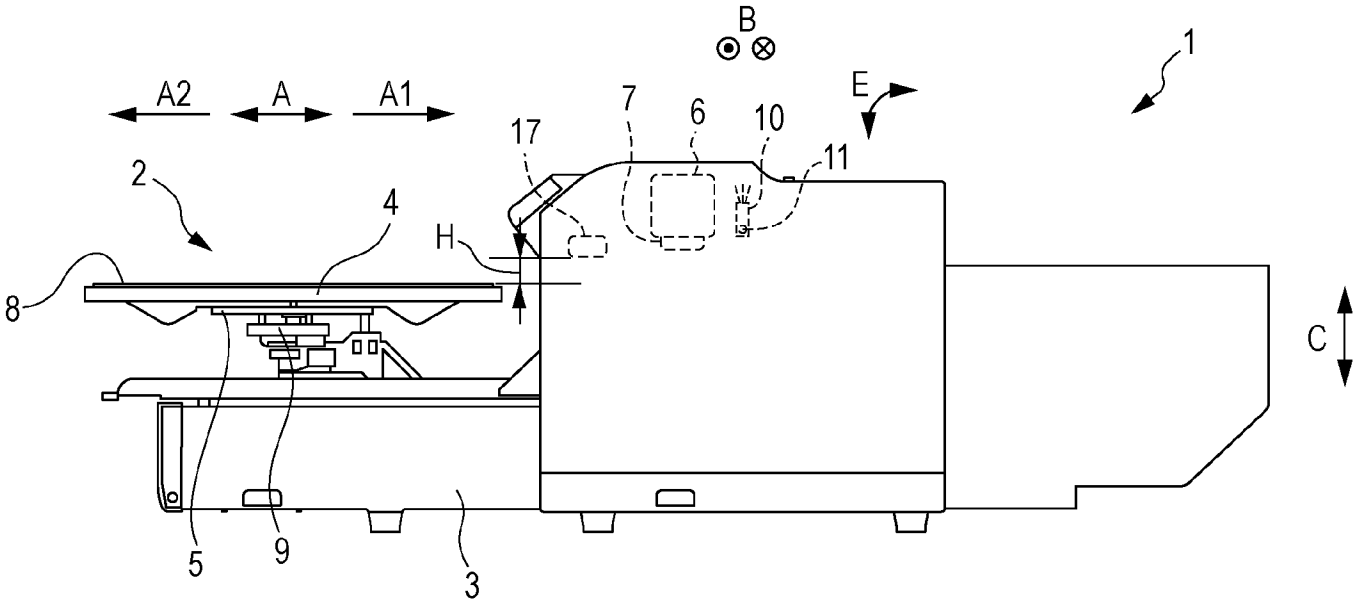
FIG. 12 is a schematic side view of a printing apparatus according to a second embodiment of the invention.

Second Embodiment (FIG. 12)

Subsequently, a printing apparatus 1 according to a second embodiment will be described.

FIG. 12 is a schematic side view of the printing apparatus 1 according to the embodiment. Constituent members which are common to those in the first embodiment are given the same reference numerals, and detailed descriptions thereof will be omitted.

In the printing apparatus 1 according to the first embodiment, the contact unit 10 is provided between the set position and the carriage 6 in the movement direction A.

Meanwhile, in the printing apparatus 1 according to the embodiment, the contact unit 10 is provided on the side opposite to the set position with respect to the carriage 6 in the movement direction A. In other words, the contact unit 10 is provided between the printing start position and the carriage 6 in the movement direction A. By adopting such a configuration, it is possible to improve a state of the printing face of the material for textile printing M immediately before performing printing, compared to the printing apparatus 1 according to the first embodiment. In addition, in the printing apparatus 1 according to the embodiment, since it is also possible to cause the contact unit 10 to be in contact while performing printing (in printing apparatus 1 according to the first embodiment, there is concern of deteriorating image quality when causing contact unit 10 to be in contact with printing face on which image is formed), a state of the printing face of the material for textile printing M can be improved while performing printing, using destaticizing, or the like.

The printing apparatus 1 according to the embodiment is provided with an optical sensor 17 as a detecting unit which detects an object located at a position of a predetermined height H or more with respect to the tray 4 (support face 8).

Since the optical sensor 17 can detect an object in a non-contact manner, for example, it is possible to detect the object in a case in which there is an obstacle on the printing face of the material for textile printing M, without deteriorating a printing condition when performing printing on the material for textile printing M, after improving the printing condition when performing printing on the material for textile printing M using the contact unit 10.

That is, the printing apparatus 1 according to the embodiment can detect an obstacle using two units (contact unit 10 and optical sensor 17) in a case in which there is the obstacle on the printing face of the material for textile printing M, and accordingly, a detecting accuracy becomes high.

The optical sensor 17 according to the embodiment has a configuration in which light is radiated to the support face 8 from an irradiation unit which is provided at one end side in the scanning direction B, at a position of a predetermined height H, the light is received by a light receiving unit which is provided at one end side in the scanning direction B, and an obstacle on the printing face of the material for textile printing M is detected by whether the light is received or not. However, it is not limited to such a configuration.

The invention is not limited to the above described embodiments, can be variously modified in the scope of the invention which is described in claims, and it is needless to say that those are also included in the scope of the invention.

This application claims priority under 35 U.S.C. § 119 to Japanese Patent Application No. 2015-240285, filed Dec. 9, 2015. The entire disclosure of Japanese Patent Application No. 2015-240285 is hereby incorporated herein by reference.

What is claimed is:

1. A printing apparatus comprising:

a tray which supports a material for textile printing, and can move in a movement direction;

a printing unit which performs printing on the material for textile printing supported by the tray; and a contact unit which is provided at a position of being in actual, physical contact with the material for textile printing supported by the tray, before performing printing by the printing unit.

2. The printing apparatus according to claim 1, wherein the tray is capable of moving to a first position at which the material for textile printing is mounted, and wherein the contact unit is provided between the first position and the printing unit.

3. The printing apparatus according to claim 2, wherein the tray is capable of moving to a second position as a standby position before starting printing on the material for textile printing, and wherein the contact unit is displaced between a contact position of being in contact with the material for textile printing which is supported by the tray and a non-contact position of not being in contact with the material for textile printing which is supported by the tray, and is displaced so as to be located at the contact position when the tray moves toward the second position from the first position, and located at the non-contact position when the tray moves toward the first position from the second position.

4. The printing apparatus according to claim 1, further comprising:

a cleaning unit which removes foreign substances attached to the contact unit.

5. The printing apparatus according to claim 1, wherein the contact unit is configured of a material with conductivity.

6. The printing apparatus according to claim 1, wherein the contact unit includes a sensor which detects an object on the tray by being in contact with the object on the tray.

7. The printing apparatus according to claim 1, further comprising:

a detecting unit which detects an object located at a position of a predetermined height or more with respect to the tray.

* * * * *